US006364362B1

(12) United States Patent
Severin

(10) Patent No.: US 6,364,362 B1
(45) Date of Patent: Apr. 2, 2002

(54) ORGANIZATIONAL APPARATUS

(76) Inventor: Pamela L. Severin, 15 Kingsbridge La., Mendon, NY (US) 14506

( * ) Notice: Subject to any disclaimer, the term of this patent is extended or adjusted under 35 U.S.C. 154(b) by 0 days.

(21) Appl. No.: 09/629,253

(22) Filed: Jul. 31, 2000

Related U.S. Application Data

(63) Continuation-in-part of application No. 09/170,530, filed on Oct. 13, 1998.

(51) Int. Cl.[7] ..... B42D 15/00; B42F 21/00; B42F 21/06

(52) U.S. Cl. ..... 283/17; 281/17; 281/19.1; 281/29; 281/31; 281/38; 281/15.1; 281/16; 283/36; 283/37; 283/38; 283/39; 283/40; 283/41; 283/42; 283/56; 283/67; 283/63.1; 402/79; 402/70; 402/73; 434/323; 434/350

(58) Field of Search ..... 281/17, 19.1, 29, 281/31, 38, 16, 15.1; 283/36, 37, 38, 39, 40, 41, 42, 56, 63.1; 434/350, 323; 402/79, 70, 73

(56) References Cited

U.S. PATENT DOCUMENTS

| | | | | | |
|---|---|---|---|---|---|
| 4,852,910 | A | * | 8/1989 | Taffer | 283/67 |
| 4,973,086 | A | * | 11/1990 | Donnelly et al. | 283/37 |
| 5,586,829 | A | * | 12/1996 | Schwartz | 402/79 |
| 5,921,582 | A | * | 12/1996 | Gusak | 283/67 |
| 5,975,580 | A | * | 11/1999 | Insalaco | 283/67 |
| 6,217,074 | B1 | * | 4/2001 | Conley, Jr. | 281/15.1 |

OTHER PUBLICATIONS

Pen–Tab Pro Planner and Project Organizer, 1999.*
Pocket Plus Notebooks, 1996.*

* cited by examiner

*Primary Examiner*—Willmon Fridie, Jr.
*Assistant Examiner*—Mark Henderson
(74) *Attorney, Agent, or Firm*—Brian B. Shaw, Esq.; Stephen B. Salai, Esq.; Harter, Secrest & Emery LLP

(57) ABSTRACT

The present invention relates to an educational planner for providing a cooperative system of planning books and folders that promote socially beneficial aims while providing assistance and organization of course materials.

15 Claims, 20 Drawing Sheets

ORGANIZATIONAL APPARATUS

This application is a Continuation-in-Part of U.S. Pat. application Ser. No. 09/170,530 filed on Oct. 13, 1998 naming Pamela Severin as inventor.

FIELD OF THE INVENTION

The present invention relates to apparatuses for students that help them organize their classwork and schedule. Specifically it relates to apparatuses that have components that share identifying indicia.

BACKGROUND OF THE INVENTION

In the past, organizational apparatuses have been marketed to the public. These apparatuses have included folders, notebooks, binders, or central planners.

When an organizational system has multiple independent components, it becomes desirable to be able to correlate components containing related material or information. For example, It is known that color has been used in at least one household planning system. All components containing materials relating to Debts may be colored red. It is not known whether color has been used in any prior educational system.

A problem with the prior art is that one indicium may not be enough for some people. Different people respond to various cues in different ways. Some may make a strong association among objects having the same color. Others (especially the colorblind) may respond better to alphanumeric labels.

Further, it would be desirable to have a central plan book that has a section that relates to each subject, which the user can also correlate to independent components containing related material or information.

SUMMARY OF THE INVENTION

It is an object of the invention to provide an apparatus for students to easily associate their materials for each class.

The present invention is an organizational apparatus including a master planner having a first plurality of sections, at least one section having a plurality of subsections, each subsection having corresponding distinct identifying indicia. It further includes a plurality of storage units, each storage unit bearing identifying indicia corresponding to that of a subsection, to provide a one-to-one correspondence between the subsections and the storage units.

The present invention is designed to provide structure for academic organization, promote continuity within individual courses, provide compatibility with an educational plan book, allow students to quickly locate course material, identify responsibilities, track performance, and support social concerns.

BRIEF DESCRIPTION OF THE PREFERRED EMBODIMENTS

DETAILED DESCRIPTION OF THE DRAWINGS

The present invention is an organizational apparatus for presenting social policies to students in conjunction with specific academic topics.

Figure 1:
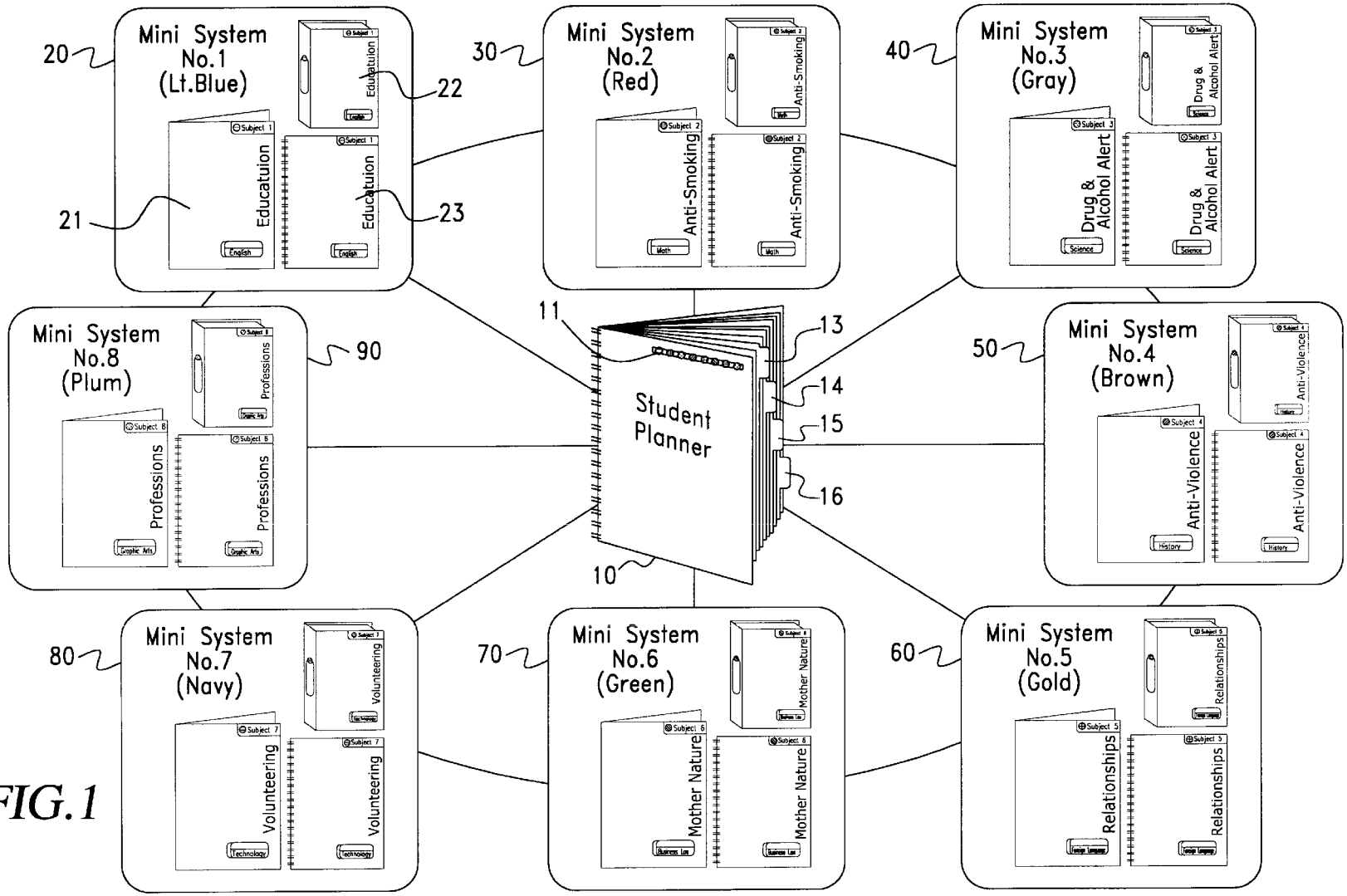
FIG. 1 is a schematic of the Master System including an educational plan book and a plurality of mini-systems having storage devices.

As shown in FIG. 1, the organizational apparatus includes a master planner 10 and a plurality of mini-systems. These systems include a folder 21, a notebook 23, and a book cover 22. The master planner for this invention is designed for students. Throughout the description and the claims it will also be referred to as an educational plan book. While folders, notebooks, and book covers are a preferred embodiment for storing papers and books, other storage units capable of retaining sheets or books would be acceptable.

Figure 2:
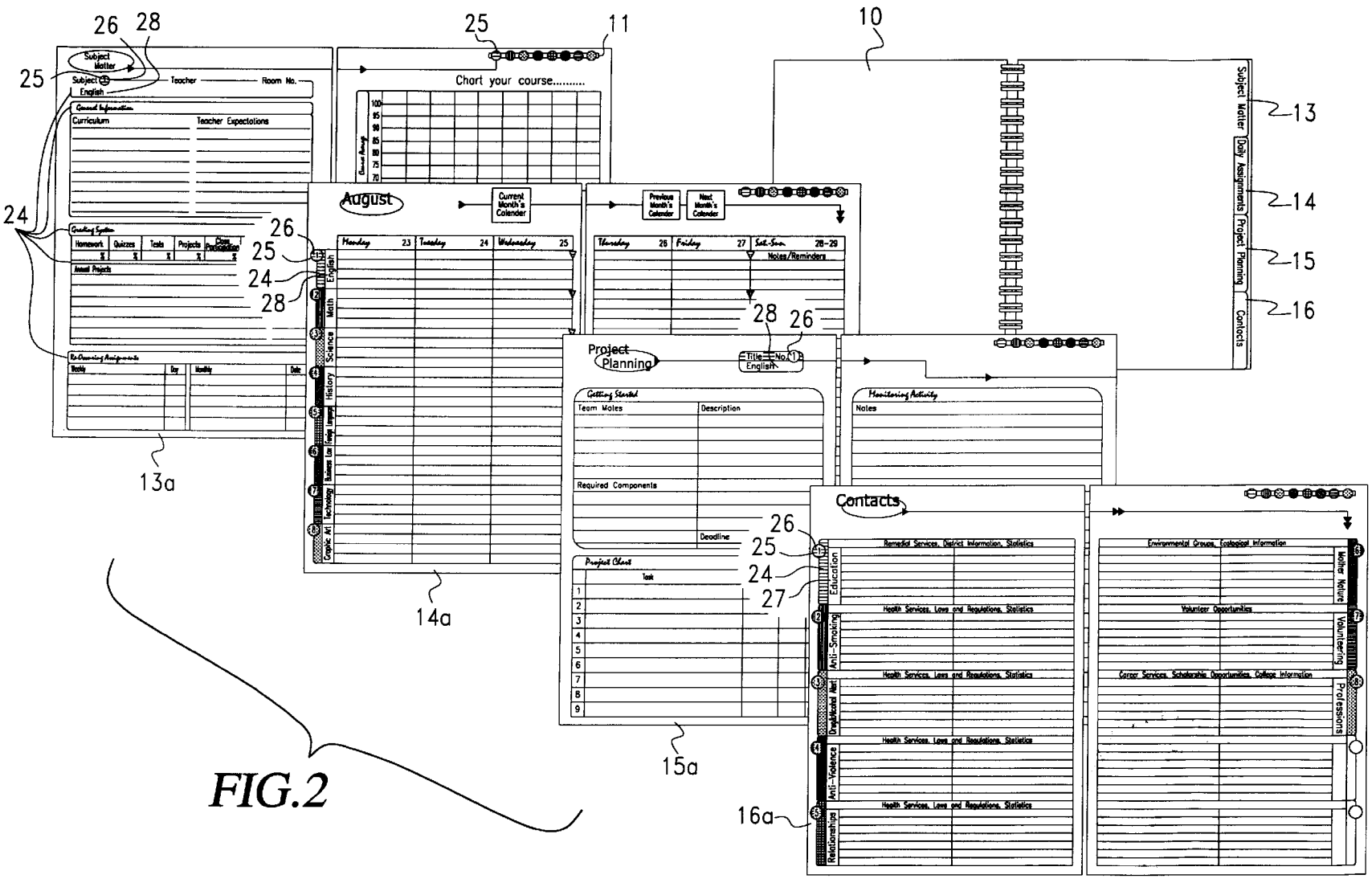
FIG. 2 shows the educational plan book in an open position, along with subject matter pages, calendar pages for daily assignments, project planning pages, and contacts pages contained therein.

The plan book 10 includes a plurality of sections. These include a subject matter section, a daily assignments section, a project planning section, and a contacts section. Sample pages from each section are shown in FIG. 2. Each section of the plan book is tabbed and labeled for easy reference.

Within each section is a plurality of subsections. Each subsection is marked by a number of identifying indicia. Colors and numerals are presently being used, but it is recognized that other symbols or icons may be used to identify a subsection. Colored bubbles, buttons, balls, or swirled circles are exactly duplicated between cross-referenced units. The present invention includes an icon bar 11 with a series of colored balls spaced along it. Each ball shares its color with a corresponding mini-system. The indicia for each subsection within a section are different from other subsections within a section. No two subsections within a section share the same indicia. However, a subsection may be related to other subsections within other sections through cross-referenced indicia.

Figure 3:
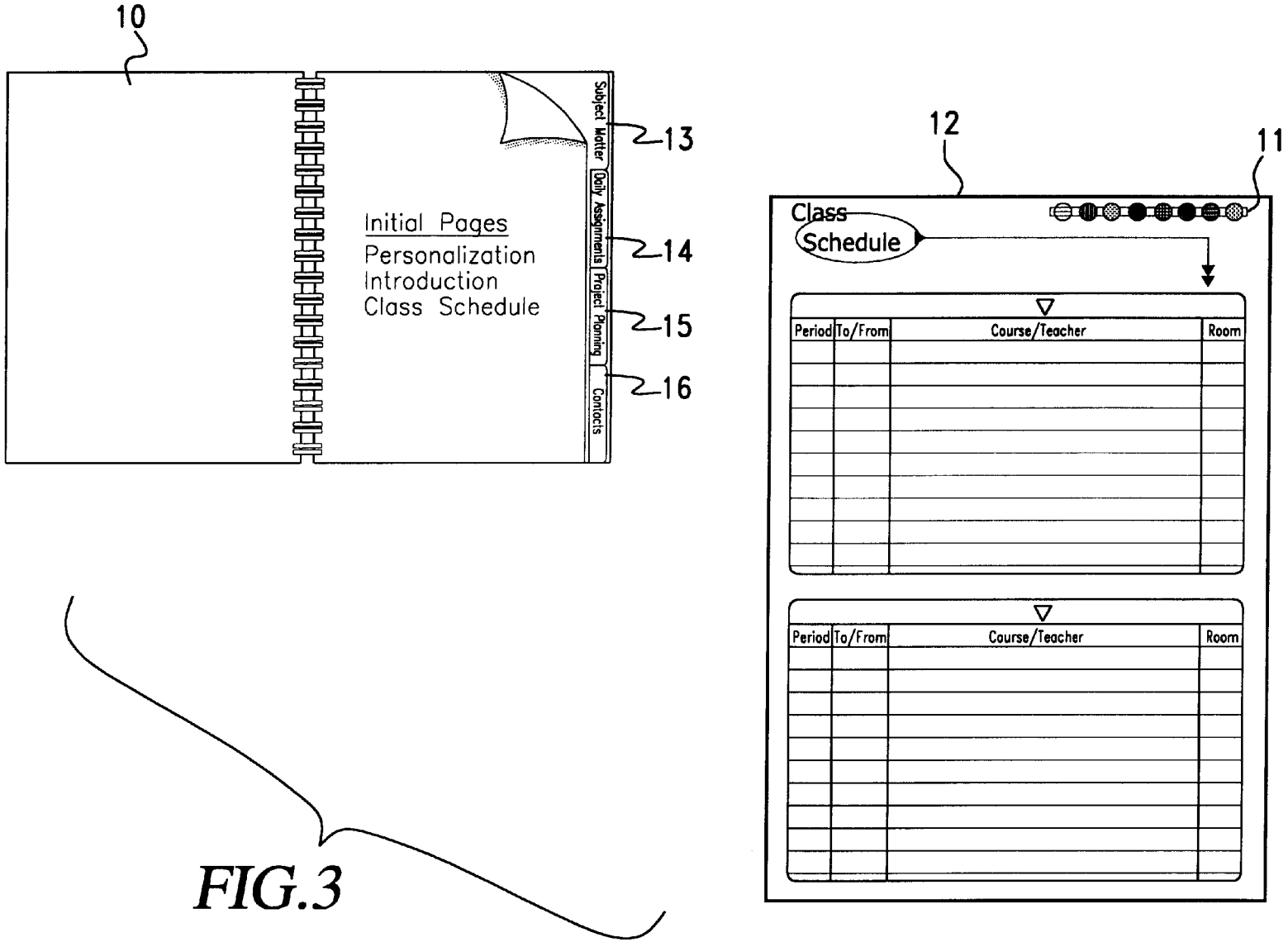
FIG. 3 shows the educational plan book in an open view and a class schedule contained therein.
Figure 4:
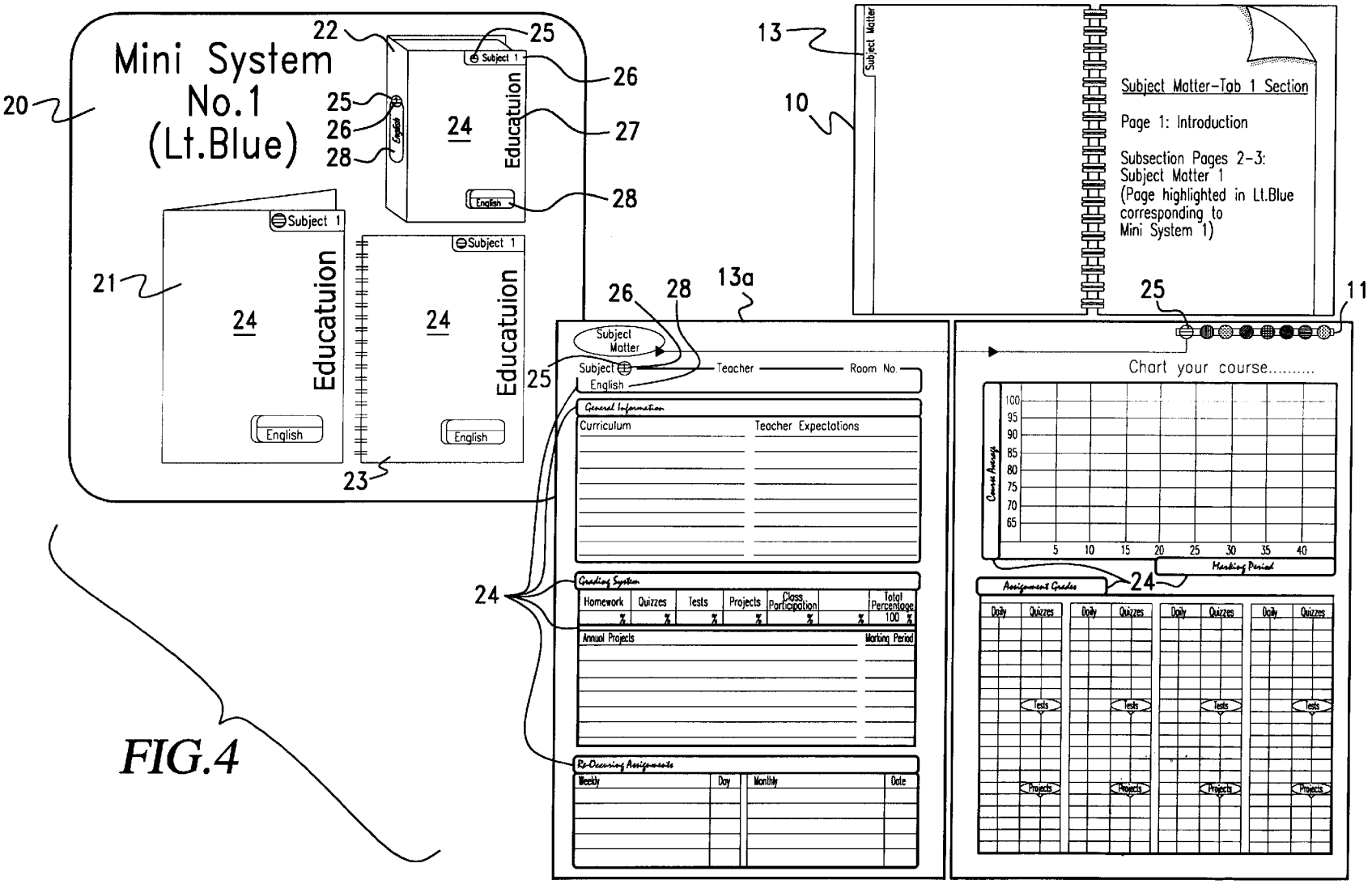
FIG. 4 shows the educational plan book in an open view, subject matter sheets bearing a first set of indicia contained in a subject matter section therein, and a mini-system with corresponding indicia.
Figure 5:
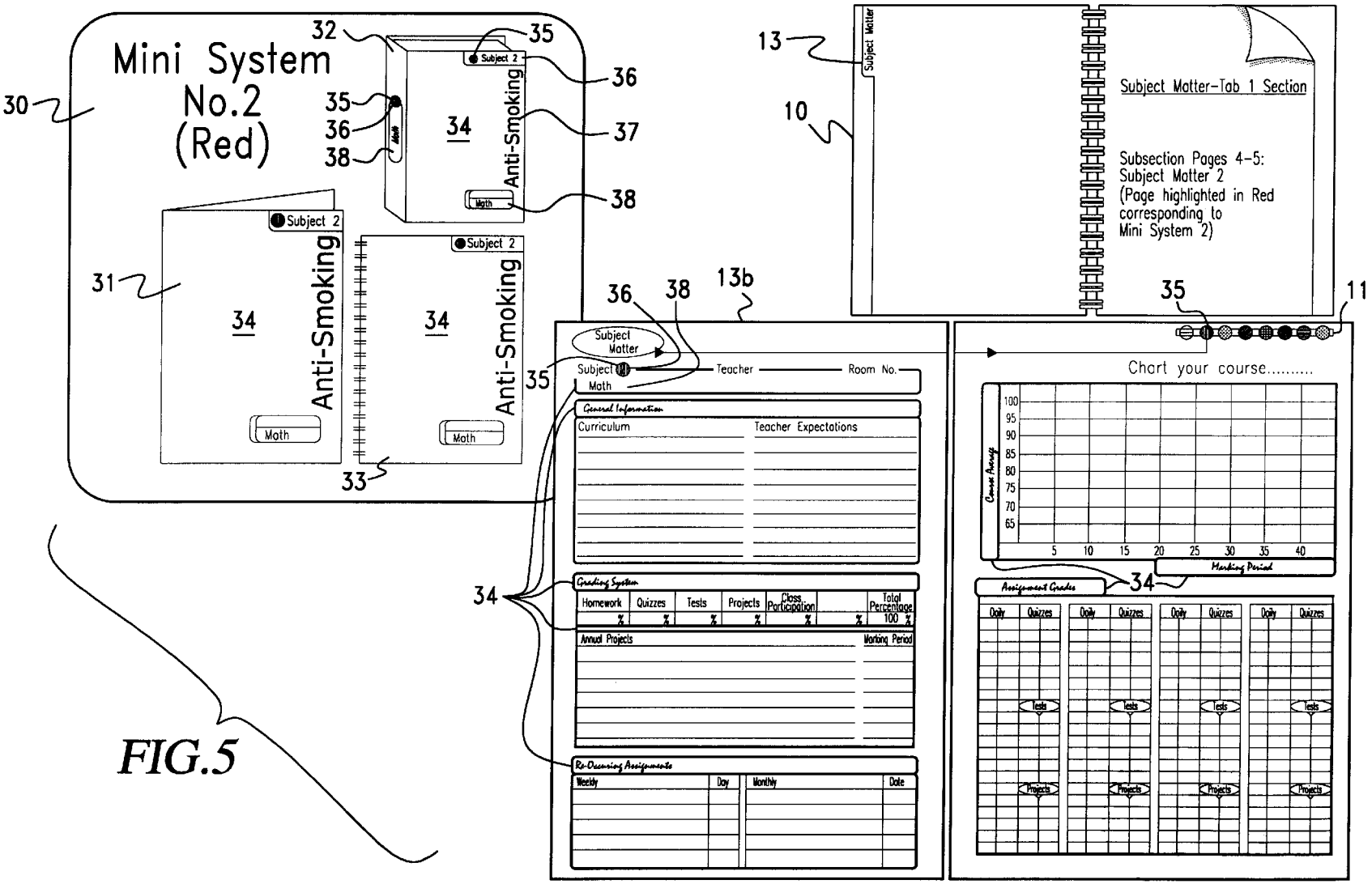
FIG. 5 shows the educational plan book in an open view, subject matter sheets bearing a second set of indicia contained in a subject matter section therein, and a mini-system with corresponding indicia.
Figure 6:
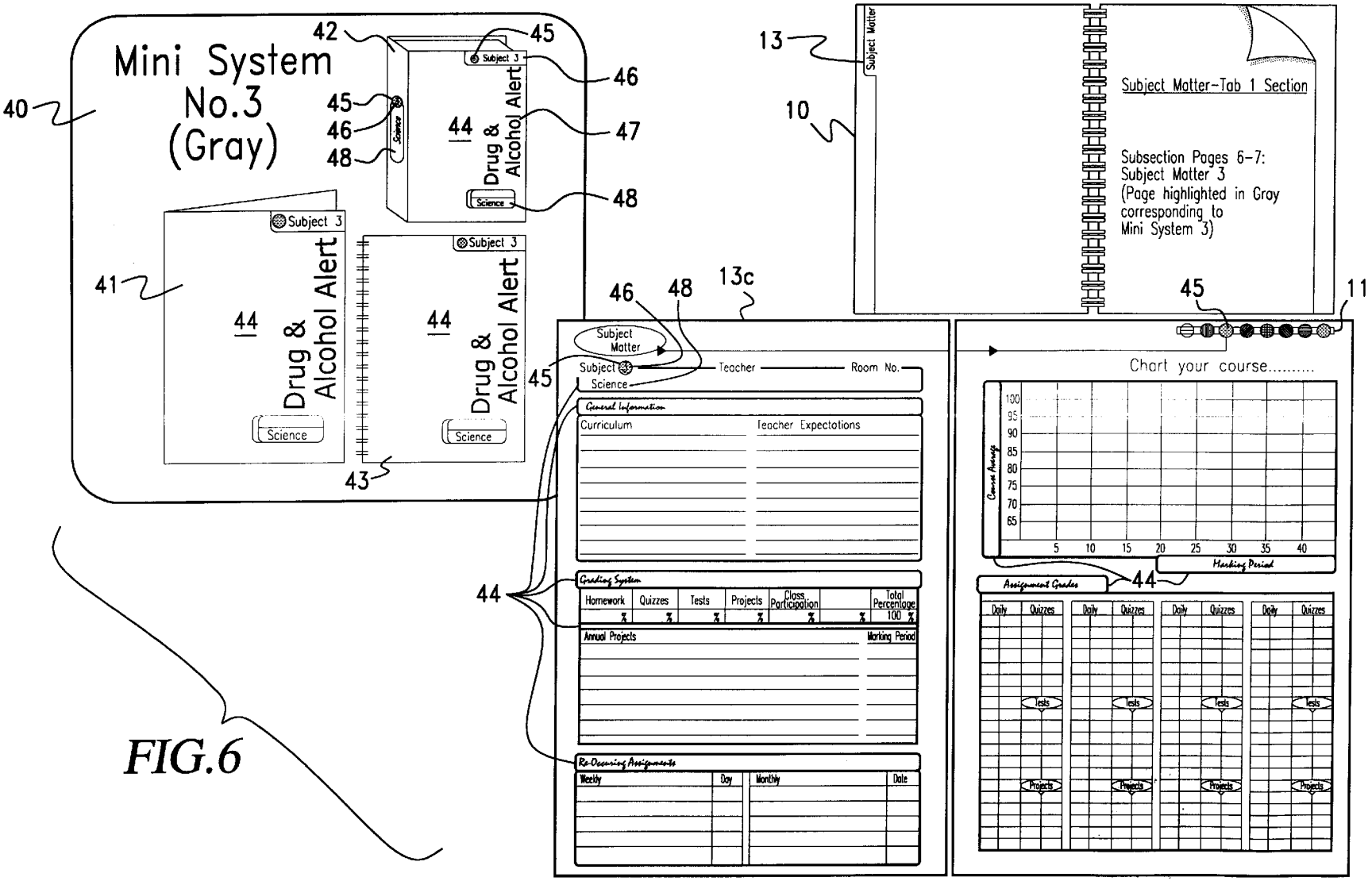
FIG. 6 shows the educational plan book in an open view, subject matter sheets bearing a third set of indicia contained in a subject matter section therein, and a mini-system with corresponding indicia.
Figure 7:
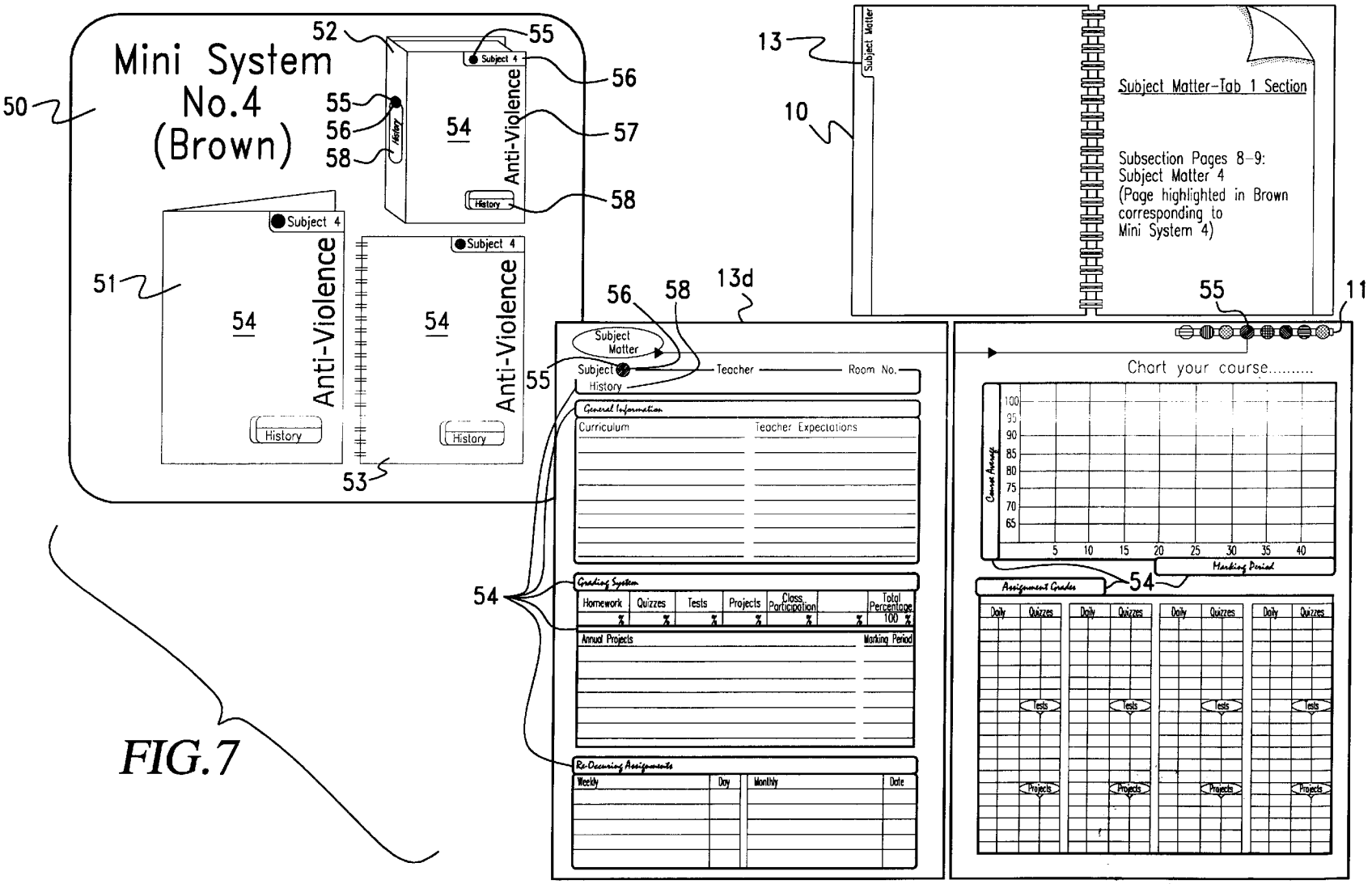
FIG. 7 shows the educational plan book in an open view, subject matter sheets bearing a fourth set of indicia contained in a subject matter section therein, and a mini-system with corresponding indicia.
Figure 8:
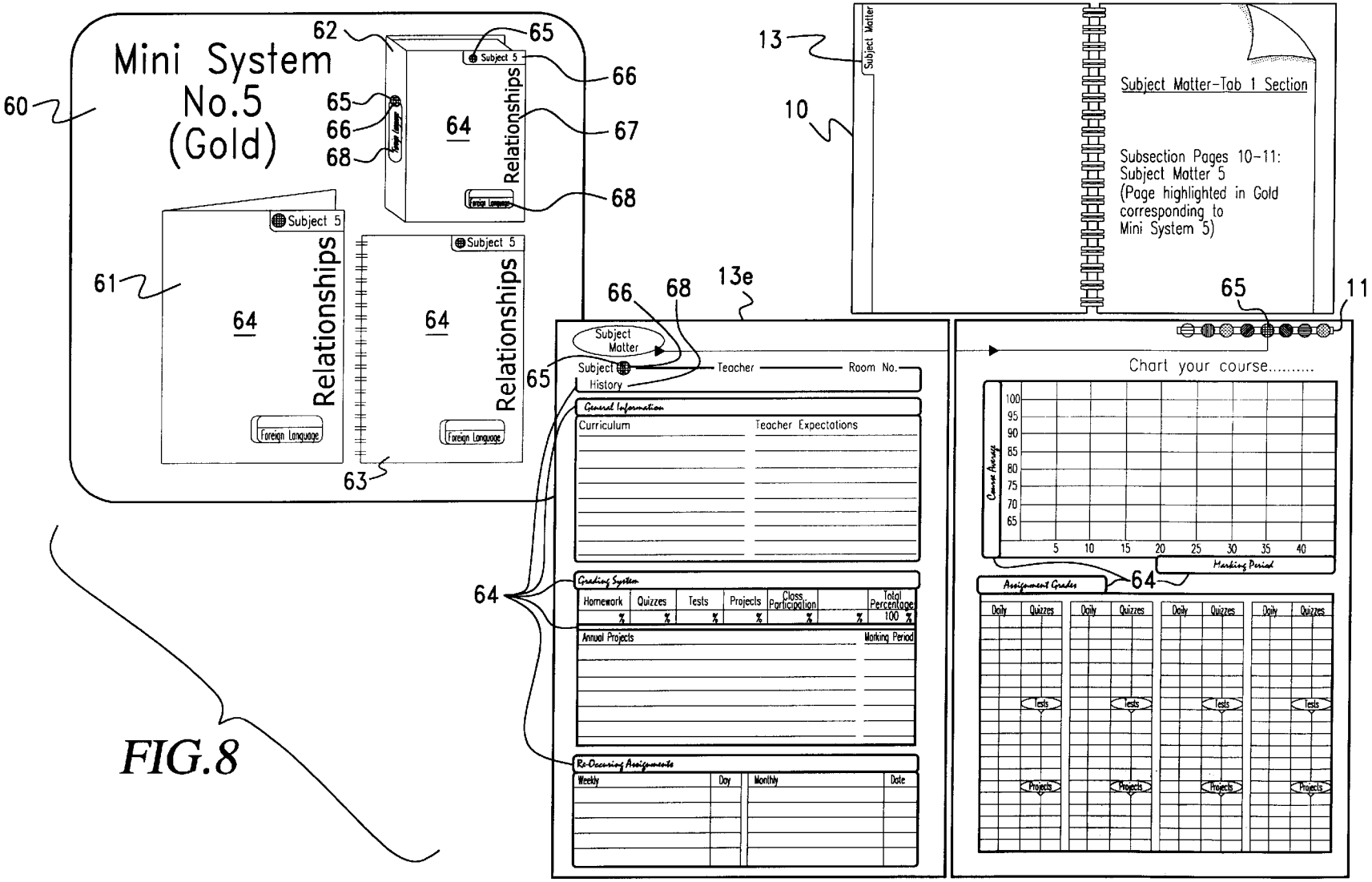
FIG. 8 shows the educational plan book in an open view, subject matter sheets bearing a fifth set of indicia contained in a subject matter section therein, and a mini-system with corresponding indicia.
Figure 9:
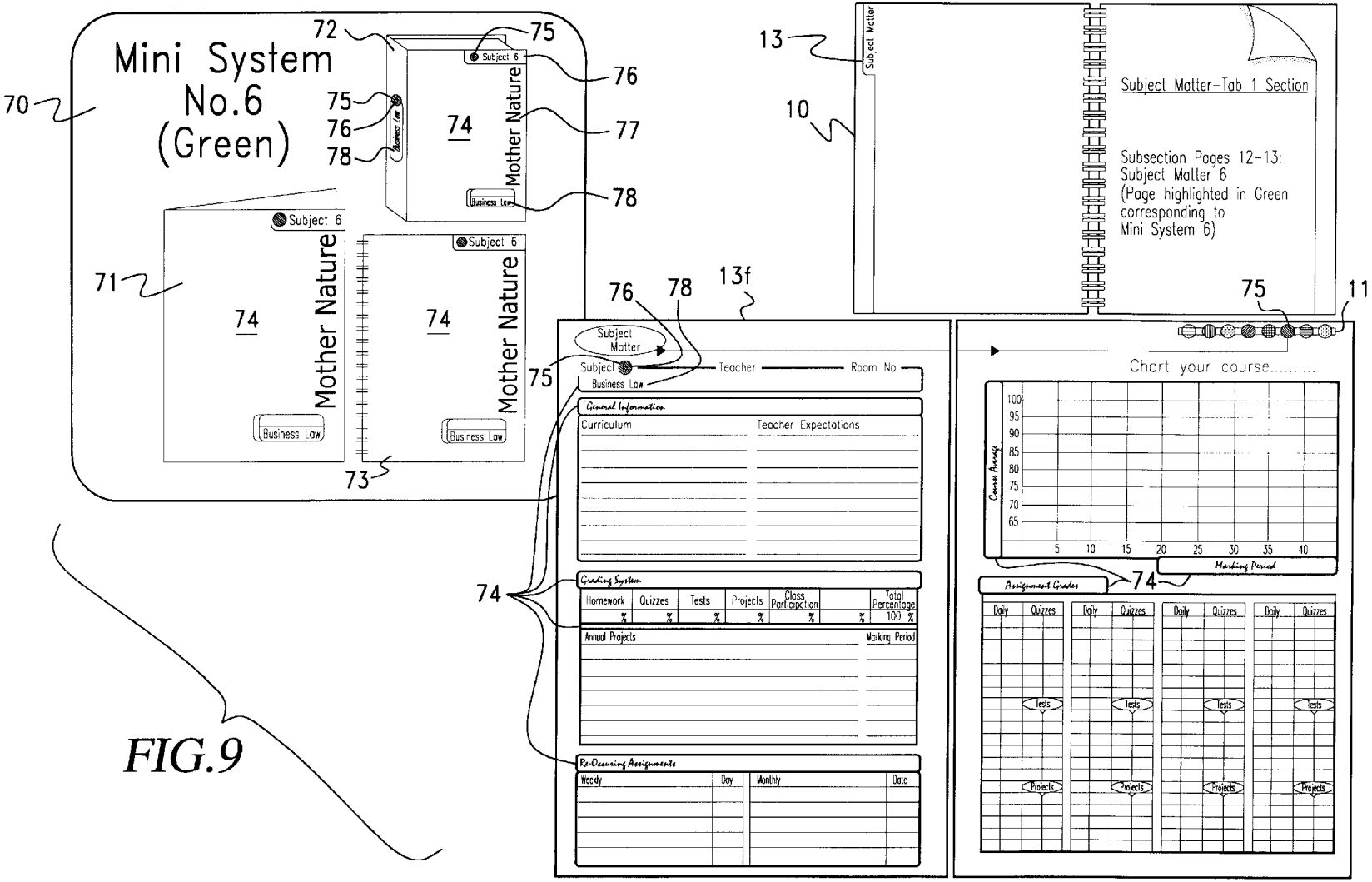
FIG. 9 shows the educational plan book in an open view, subject matter sheets bearing a sixth set of indicia contained in a subject matter section therein, and a mini-system with corresponding indicia.
Figure 10:
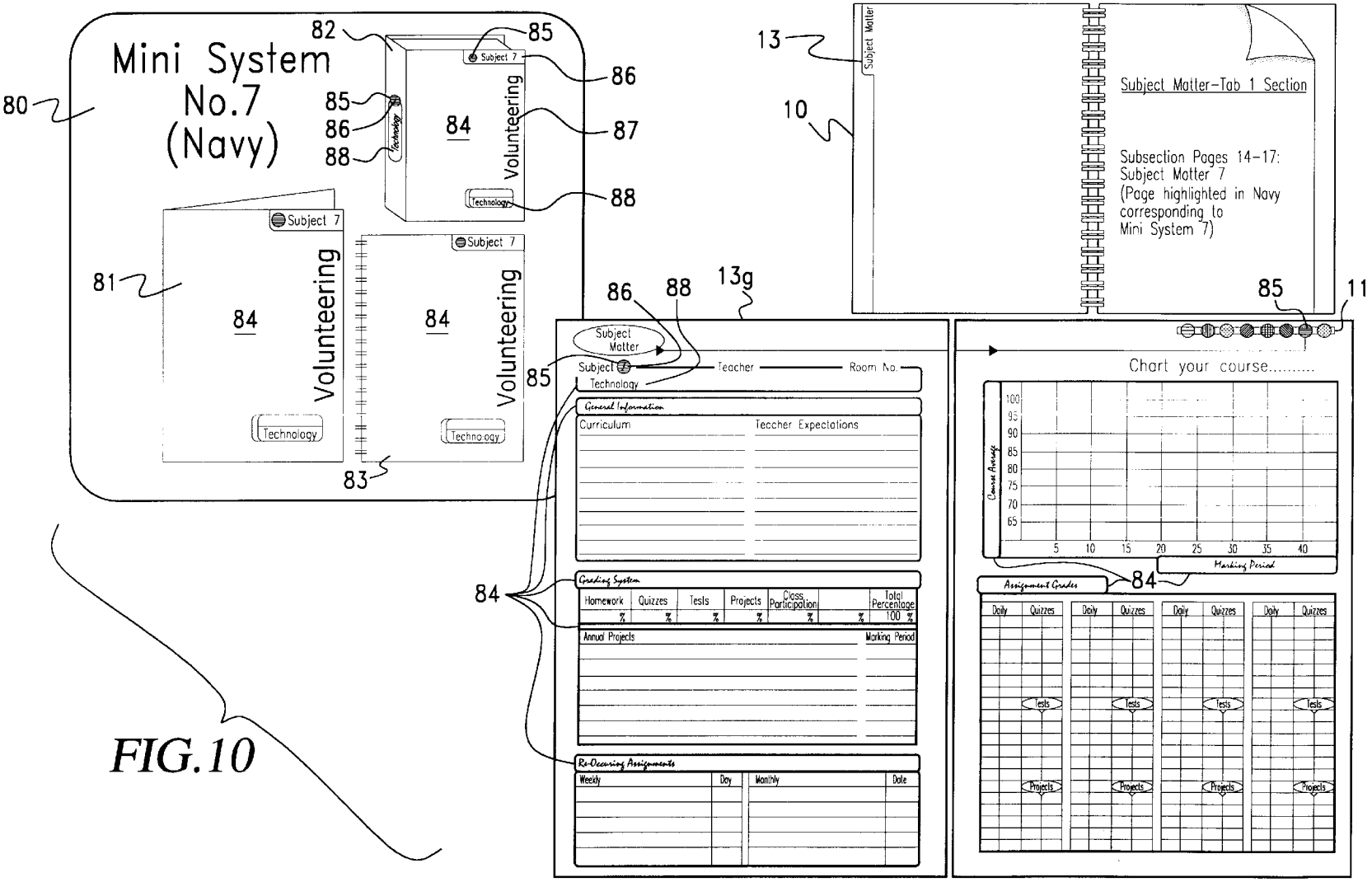
FIG. 10 shows the educational plan book in an open view, subject matter sheets bearing a seventh set of indicia contained in a subject matter section therein, and a mini-system with corresponding indicia.
Figure 11:
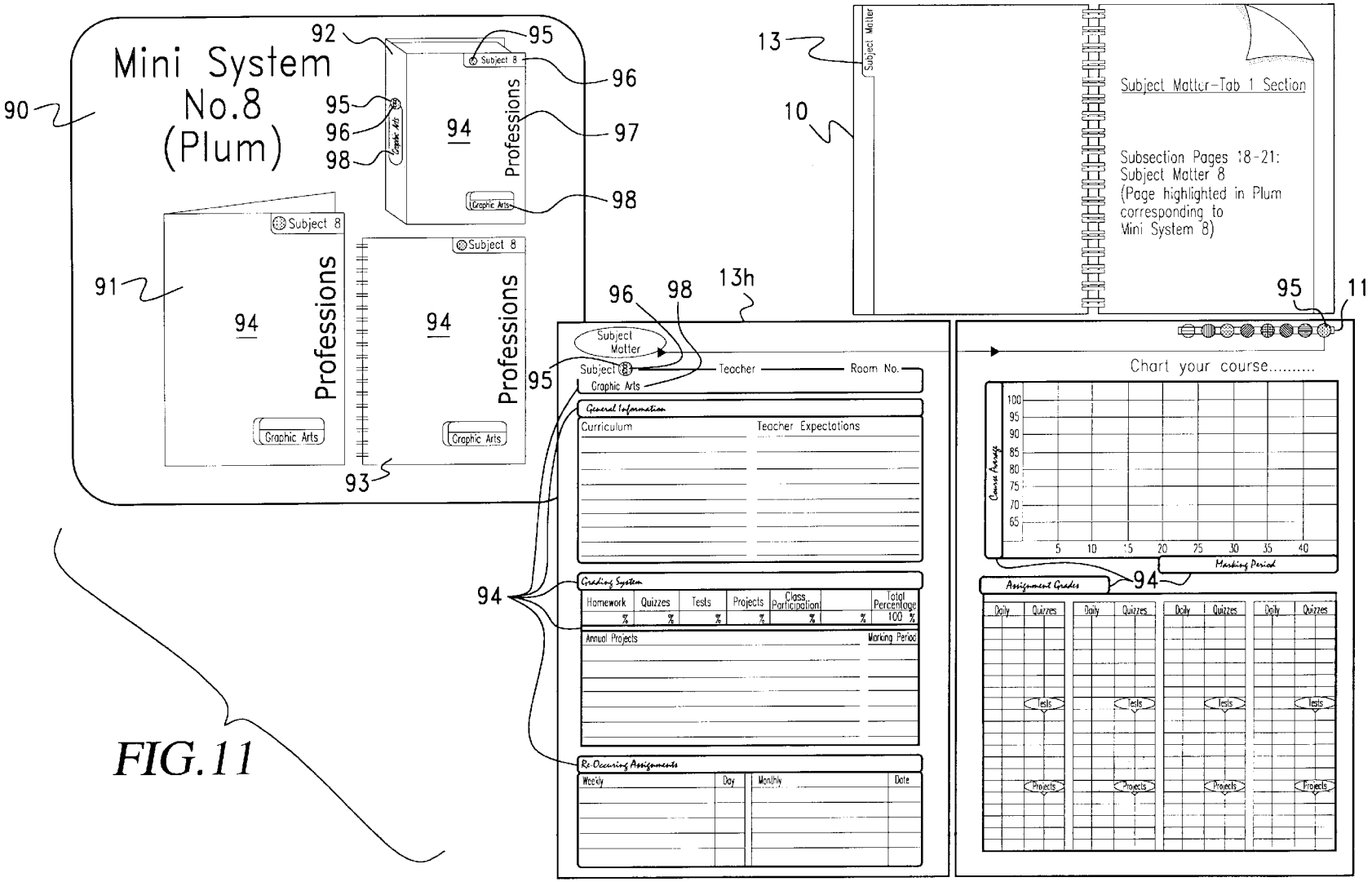
FIG. 11 shows the educational plan book in an open view, subject matter sheets bearing an eighth set of indicia contained in a subject matter section therein, and a mini-system with corresponding indicia.

In a preferred embodiment the plan book is spiral bound. The introductory pages of the planner include a class schedule 12 as illustrated in FIG. 3.

The subject matter section 13 includes a plurality of subsections. FIGS. 4–11 each show a couple pages from a subsection corresponding to a particular academic subject as referenced by numerals 13*a–h*. Each subsection in the subject matter section 13 includes a subject name, a teacher identifier field, a room number field, general information, grading system, re-occurring assignments, a graph for indicating academic progress in the topic, and assignment grades. General information includes subheadings for curriculum and teacher expectations. The grading system includes subheadings for homework, quizzes, tests, projects, class participation, and total percentage. Re-occurring assignments are broken up into weekly and monthly subdivisions.

Heavy ink lines in each academic subsection share the same color indicia as a particular mini-system. Reference numbers 24, 34, 44, 54, 64, 74, 84, and 94 represent the color indicia of each of eight mini-systems. At least one distinctive icon indicia, 25, 35, 45, 55, 65, 75, 85, or 95, is also present on each mini-system. At least one distinctive numeral indicia, 26, 36, 46, 56, 66, 76, 86, or 96, is also present on each mini-system. Finally, a distinctive subject indicium, 28, 38, 48, 58, 68, 78, 88, and 98, is also shared by both a mini-system and a subsection. Each identifying indicium associated with a particular subsection is reproduced on the folder 21, the notebook 23, and the bookcover 22.

The pockets of each folder include illustrations and guide rules elaborating a social theme that corresponds to a particular subsection's color. For example, the particular subsection illustrated in FIG. 4 may have the color blue as one of its indicium. The folder will also bear the blue indicium. Additionally, light blue folders are imprinted with the thematic message "Education" 27. Other colors also have associated themes. No effort has been made to link particular academic subjects with particular social themes. Whatever color a student chooses to identify with a color (e.g., light blue with English) determines what social theme corresponds to that subject.

In a preferred embodiment, the social themes include anti-smoking, drug and alcohol alert, anti-violence, relationships, mother nature, volunteering, and professions, in addition to education. The colors corresponding to these themes are red, gray, brown, gold, green, navy, and plum respectively. Other colors may of course be attached to these themes, just as other themes may be attached to these colors.

Figure 12:
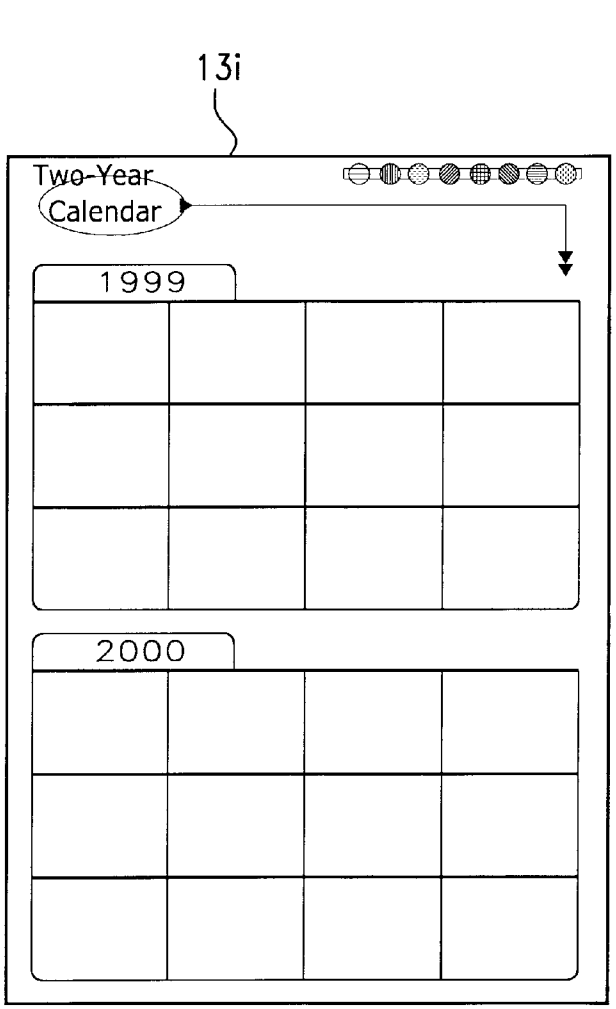
FIG. 12 shows the educational plan book open to a two-year calendar in a subject matter section.
Figure 12:
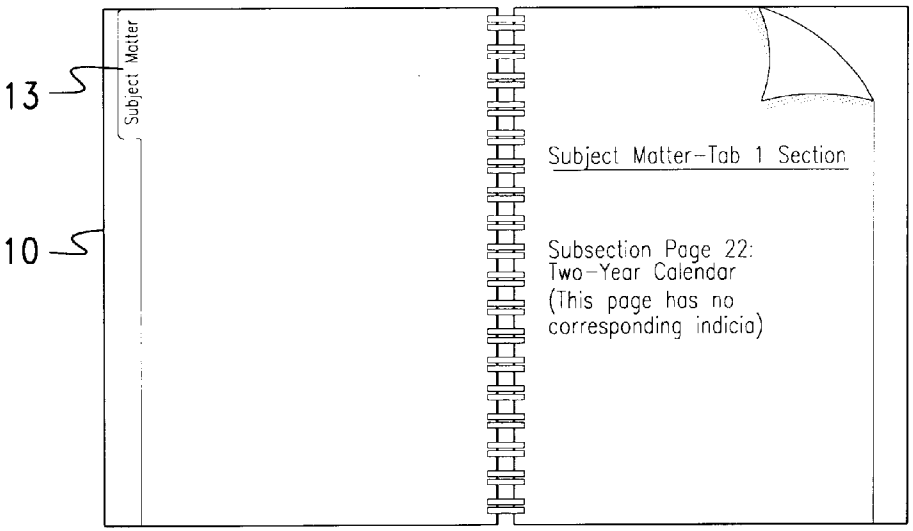

In this embodiment, there is a provision for eight traditional, formal academic subjects. Thus, the subject matter section includes eight academic subsections. There are eight separate, identifying indicium that relate particular subsections with particular mini-systems and therefore to eight social values. The system may be varied to accommodate users desiring different thematic messages or a different number of them FIG. 12 shows a subsection of the subject matter section 13 comprising a two-year calendar 13*i*. This page does not have indicia corresponding to a mini-system.

Figure 13:
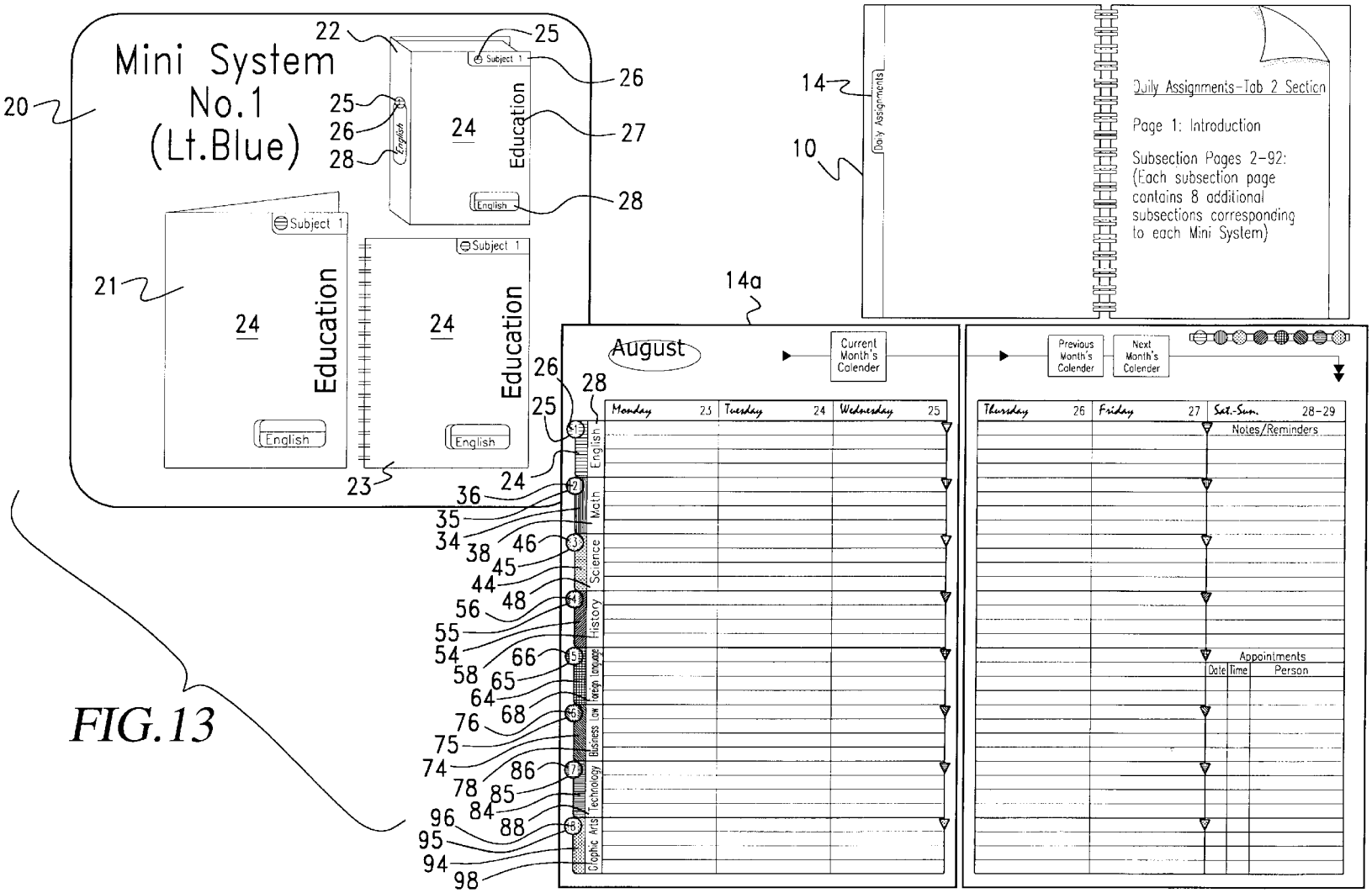
FIG. 13 shows the educational plan book in an open view, assignment pages bearing indicia, and a mini-system with corresponding indicia.

FIG. 13 illustrates a subsection of the daily assignments section 14 of the educational plan book. The daily assignments section 14 has a calendar with a plurality of subsections 14*a,* each of which bears indicia corresponding to a particular subject matter section and its corresponding mini-system. For the sake of convenience, only one mini-system, Education, is shown in FIG. 13 corresponding to one of the eight subsections. As discussed above, heavy ink lines matching the color indicia of 24, icon 25, numeral 26, and subject 28 are used to associate the subsection with the mini-system corresponding to Education.

Figure 14:
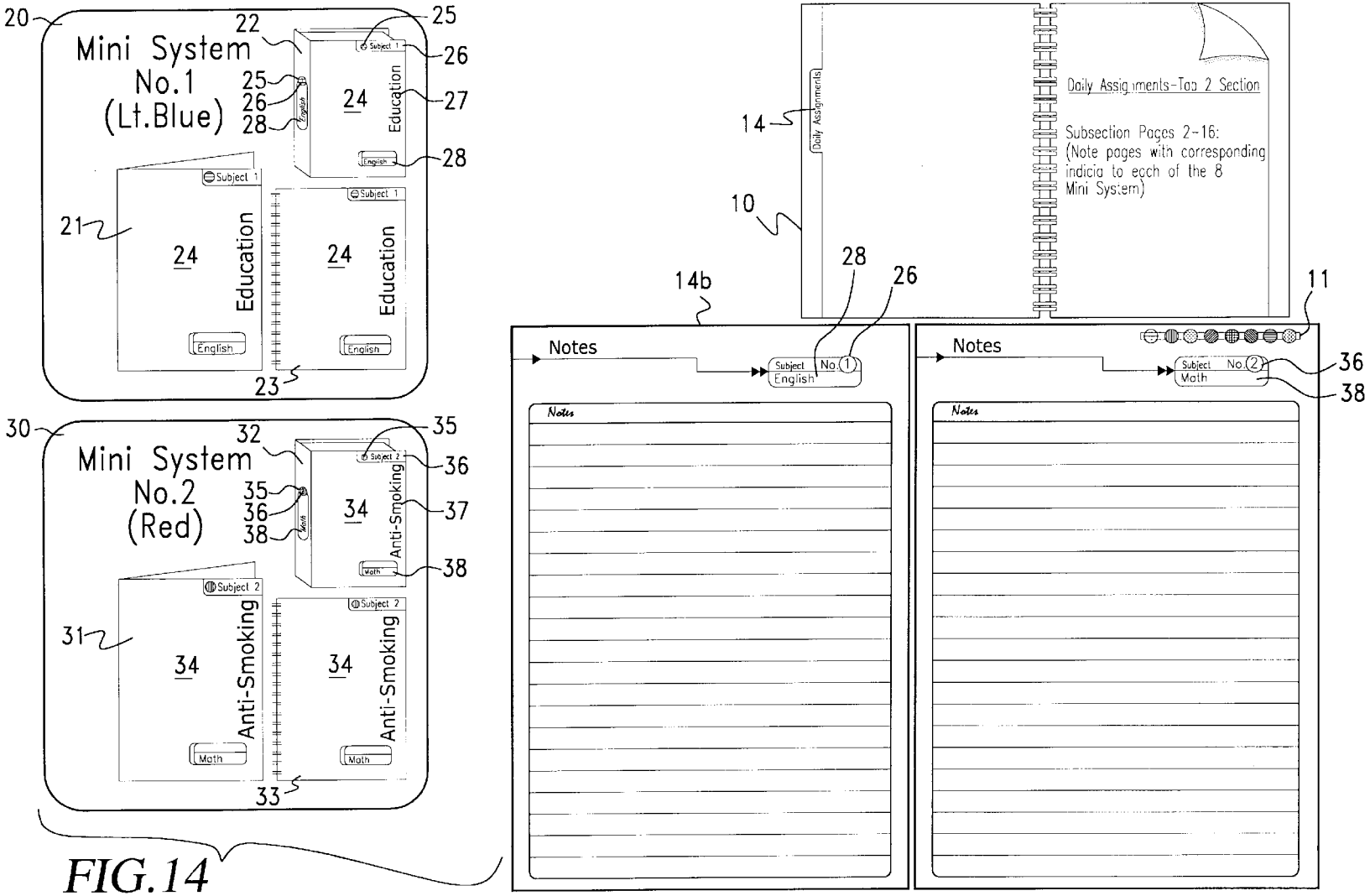
FIG. 14 shows the educational plan book in an open view, note pages bearing indicia corresponding to two separate mini-systems from the daily assignments section of the plan book, and the two corresponding mini-systems.
Figure 15:
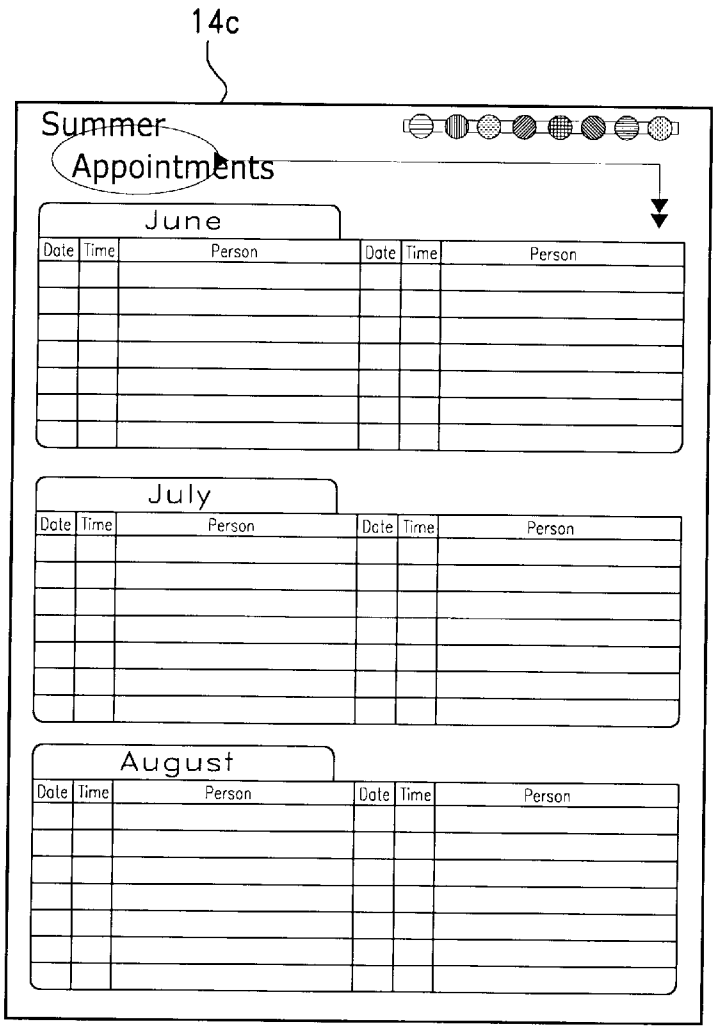
FIG. 15 shows the educational plan book open to a summer appointments section in the daily assignments section.
Figure 15:
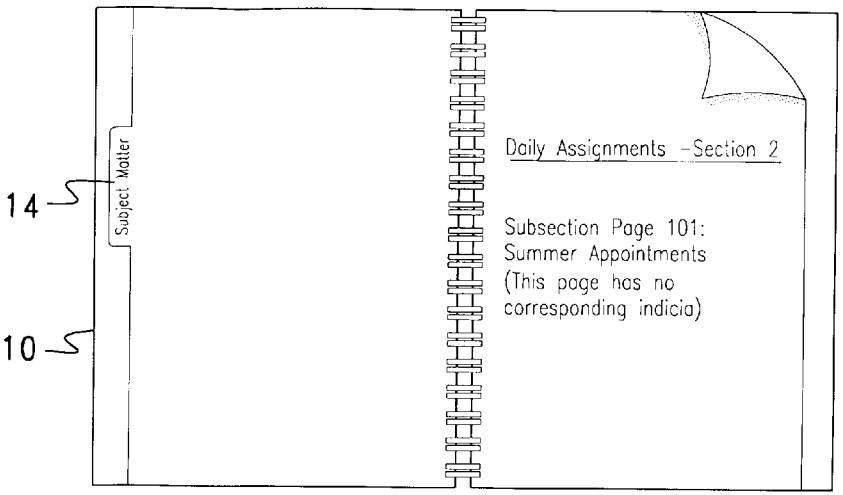

Each subsection in the daily assignments section 14 includes monthly calendars for the current month, previous month, and next month. There are daily columns and subject blocks for recording specific academic assignments as well as a section to record reminders or notes that are unrelated to a subject, and a section to record appointments for the subsection week with fields to note the date, time, and person. Also, in the daily assignments section 14 is a subsection for notes 14*b*. The notes subsection 14*b* contains pages corresponding to each and every mini-system. See FIG. 14. The daily assignments section also includes an appointments subsection 14*c* as illustrated in FIG. 15. This subsection does not have indicia corresponding to a mini-system. The appointments subsection has seasonal subheadings. Appointments for the months of June, July, and August are recorded under a subheading for summer appointments.

Figure 16:
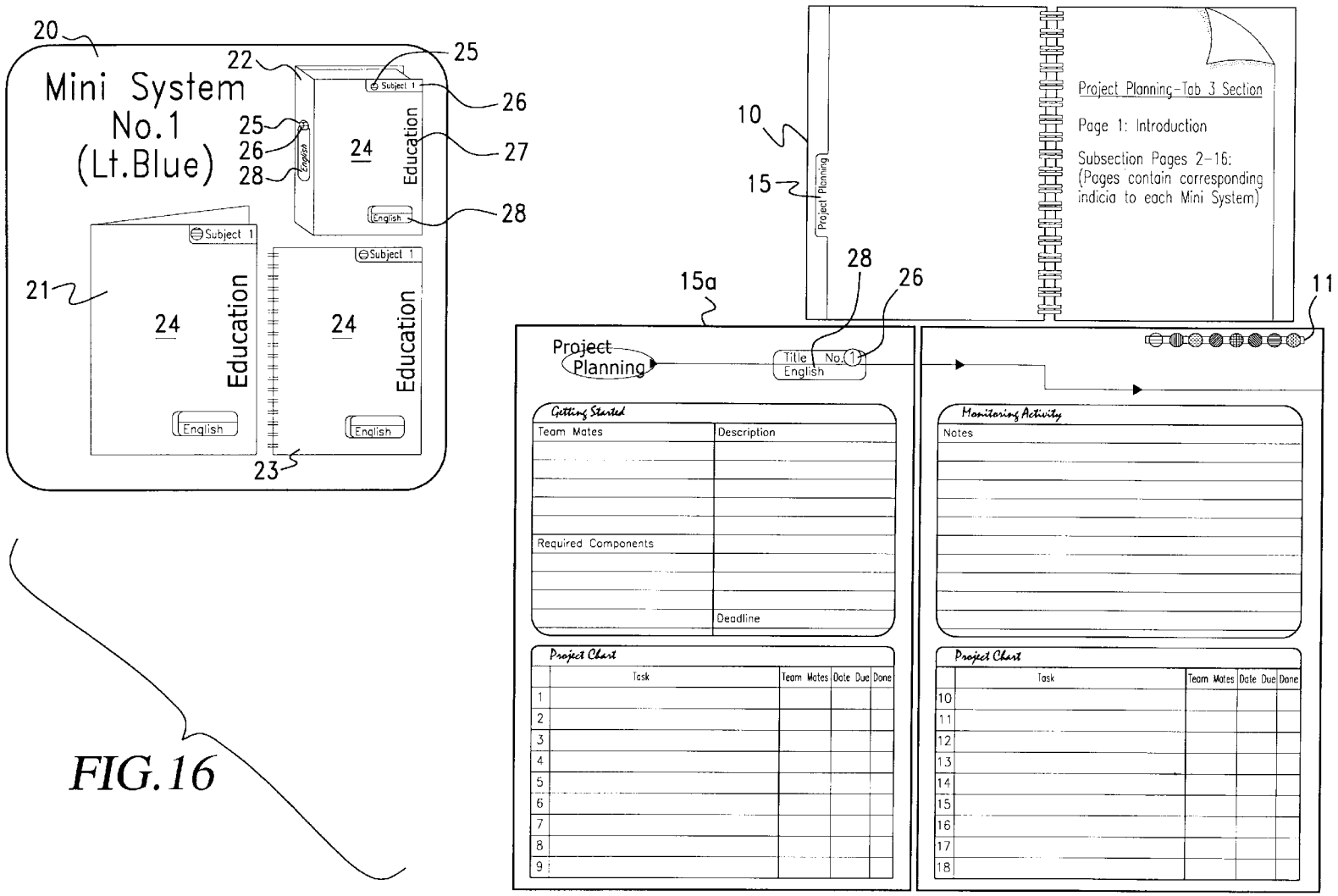
FIG. 16 shows the educational plan book in an open view, project planning pages bearing indicia from the project planning section of the plan book, and a mini-system with corresponding indicia.

FIG. 16 illustrates pages 15*a* from a subsection of the project planning section 15 of the educational plan book. In the project planning section 15, there are subheadings for getting started, project charts for indicating progress, and monitoring activity. Getting started includes subheadings for describing the project, describing the components required for completion of the project, listing teammates, and the deadline for completion. Project charting includes subheadings for listing each teammate, that teammate's task, the date due for each task, and the date each task is completed. Notes concerning the progress made on a project are added under the monitoring activity section.

Figure 17:
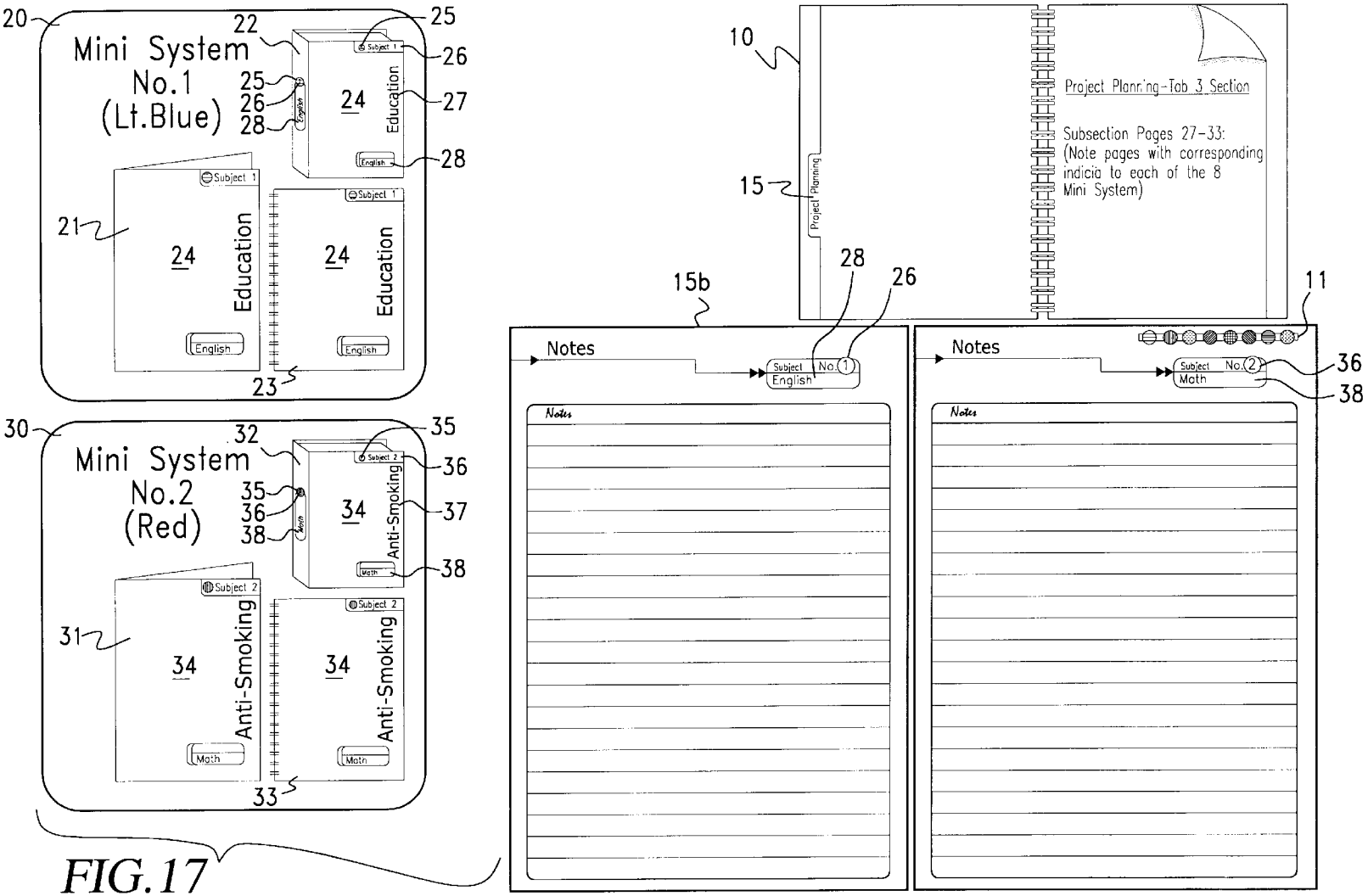
FIG. 17 shows the educational plan book in an open view, note pages bearing indicia corresponding to two separate mini-systems from a project planning section of the plan book, and the two corresponding mini-systems.

FIG. 17 shows two pages for notes 15*b* from another subsection of the project planning bearing indicia corresponding to two different subjects and mini-systems. There are note pages that correspond to each and every academic subject and mini-system. Only two are shown for the sake of convenience.

Figure 18:
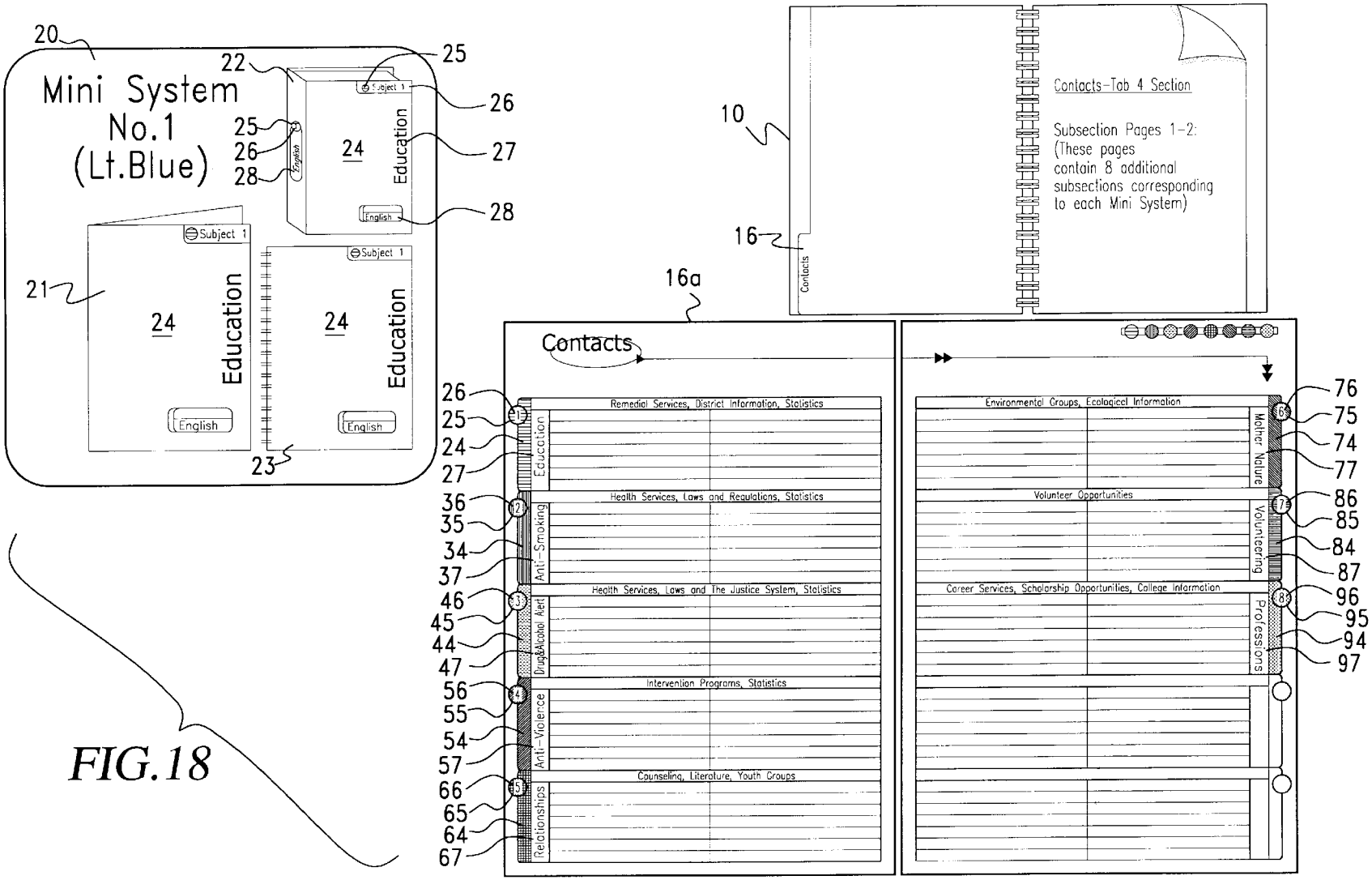
FIG. 18 shows the educational plan book in an open view, contact pages bearing indicia from the contacts section of the plan book, and a mini-system with corresponding indicia.

FIG. 18 illustrates pages 16a from eight subsections of the contacts section 16 of the educational plan book. Here the user may store contact information. There are different contact listings for different social themes; spaces for names, addresses, telephone numbers, e-mail addresses, and websites may be included. The indicia for each mini-system are included in one of the subsections.

In the preferred embodiment the contacts under education include remedial services, district information, and statistics; the contacts under anti-smoking include health services, laws and regulations, and statistics; the contacts under drug and alcohol alert include health services, laws and the justice system, and statistics; the contacts under anti-violence include intervention programs and statistics; the contacts under relationships include counseling, literature, and youth groups; the contacts under mother nature include environmental groups and ecological information; the contacts under volunteering include volunteer opportunities; the contacts under professions include career services, scholarship opportunities, and college information.

Figure 19:
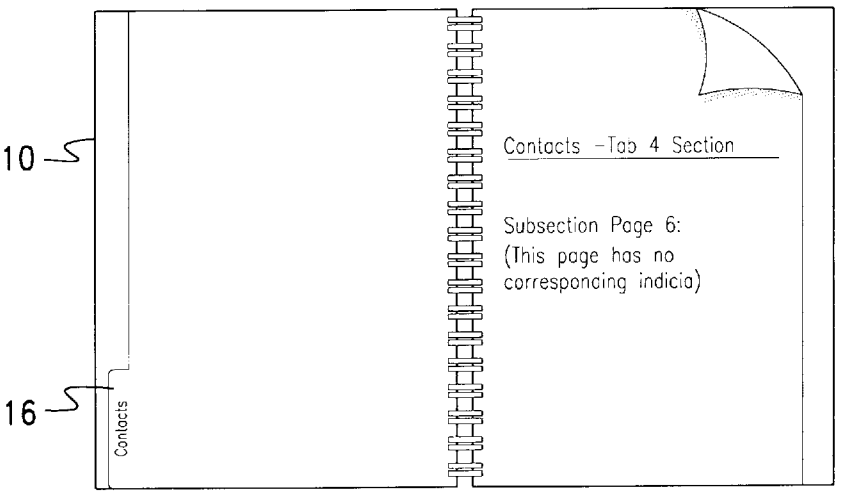
FIG. 19 shows the educational plan book in an open view and a volunteer log, which is a subsection page of the contacts section.
Figure 19:
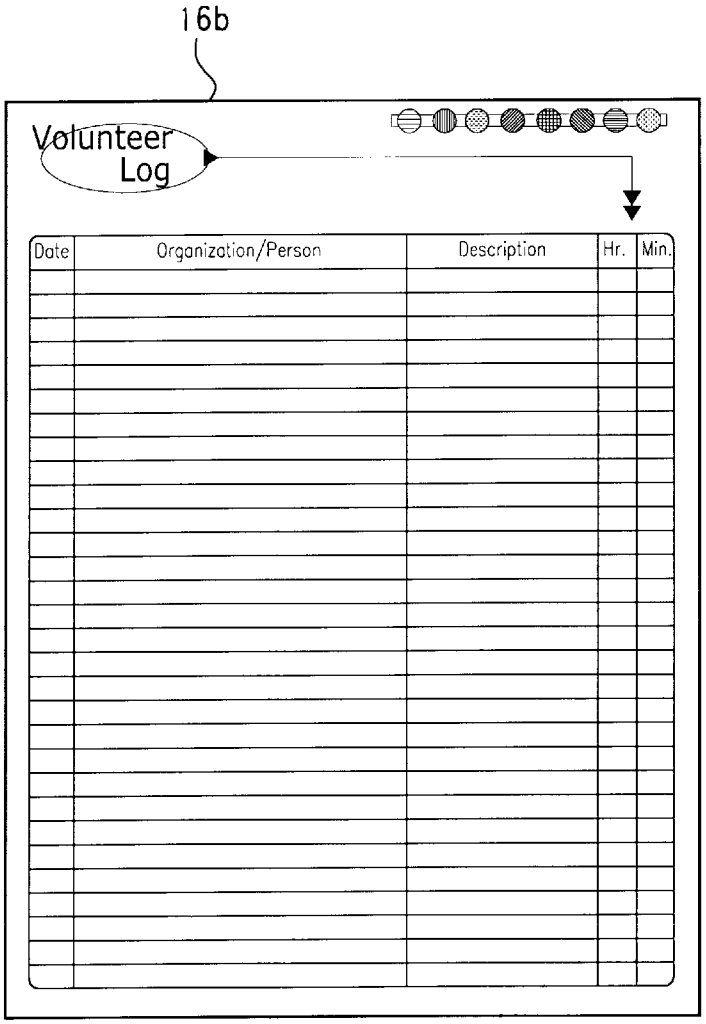

FIG. 19 shows a subsection of the contacts 16 comprising a volunteer log 16*b*. The volunteer log includes subheadings for the date of each activity, the organization or person involved in each activity, a description of each activity, and the hours and minutes worked on each activity. This page does not have indicia corresponding to a mini-system.

Figure 21:
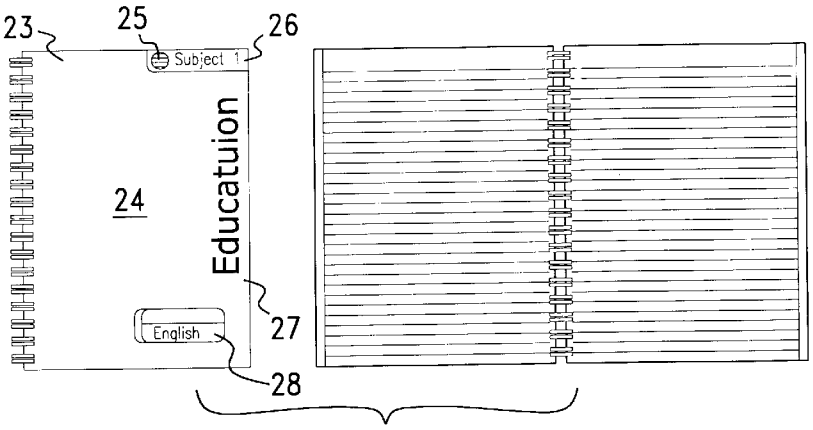
FIG. 21 shows a mini-system notebook in a closed configuration and in an open configuration.
Figure 22:
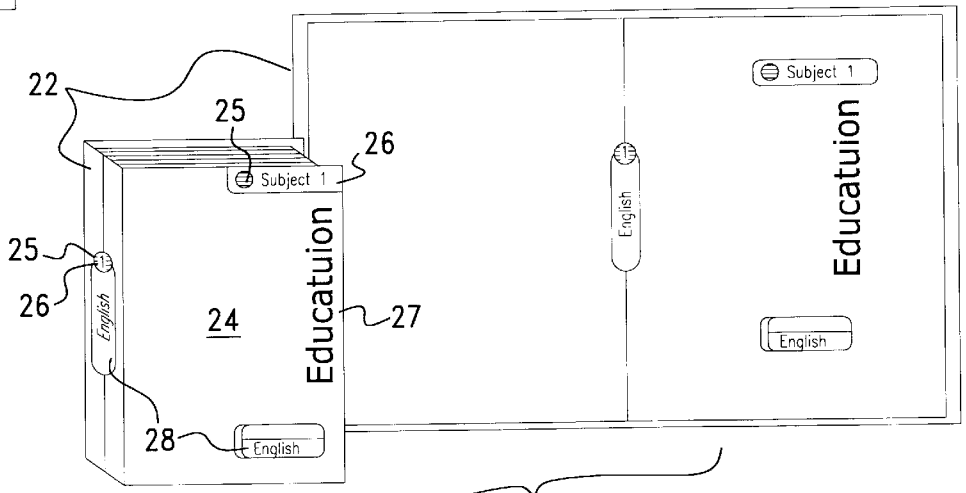
FIG. 22 shows a mini-system book cover in a closed configuration and in an open configuration.
Figure 20:
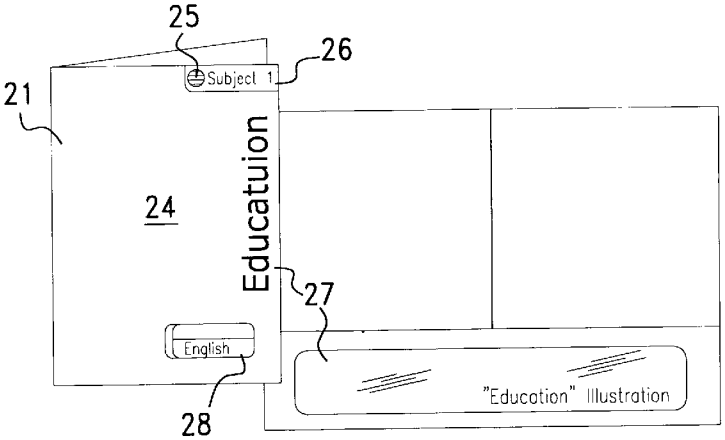
FIG. 20 shows a mini-system folder in a closed configuration and in an open configuration.

These components of each mini-system are shown in FIG. 20–22. FIG. 20 illustrates a mini-system folder 21, FIG. 22 illustrates a mini-system book cover 22, and FIG. 21 illustrates a mini-system spiral notebook 23, each one having the same indicia. The folder 21 is size to fit a plurality of sheets of paper. The book cover 22 is sized to fit around a high school level hardcover textbook. The spiral notebook 23 may be wide ruled or college ruled.

It is envisioned that there will be several differences between the high school apparatus disclosed herein and the middle and elementary apparatus also being created. The systems relating to the primary and middle school levels may or may not be tabbed sections as opposed to the high school level, which is tabbed. Both middle and elementary school levels will have a chart described as a reading log to record information on completed literature. The elementary planner will have safety tips for younger students. Also, for all three levels, there will be a common color-coding scheme with like indicia.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. An organizational apparatus, comprising:

an educational plan book having a plurality of sections including at least one section for recording daily assignments having a plurality of subsections, each subsection relating to a different academic subject and having a different identifying color; and at least one document storage unit separate and apart from the educational plan book corresponding to each of the subsections in the plan book and the storage units each having the same identifying color as its corresponding plan book subsection.

2. An organizational apparatus, comprising:

an educational plan book having a plurality of sections including at least one section for recording daily assignments having a plurality of subsections, each subsection relating to a different academic subject and having at least two distinct identifying indicia that distinguish that subsection from other subsections in the same section; and at least one document storage unit separate and apart from the educational plan book corresponding to each of the subsections in the plan book and the separate and apart storage units each having at least two of the same distinct identifying indicia as its corresponding plan book subsection.

3. The apparatus of claim 2, wherein the plan book and each of the storage units has a portion on which may be entered further identifying information.

4. The apparatus of claim 2, wherein one of the indicia is a color.

5. The apparatus of claim 2, wherein one of the indicia is a numeral.

6. The apparatus of claim 2, wherein one of the indicia is a graphical icon.

7. The apparatus of claim 2, wherein each subsection relating to an academic subject further comprises a calendar.

8. The apparatus of claim 2, wherein one section is a project planning section, including a list for project charts, and calendar dates for indicating progress.

9. The apparatus of claim 2, wherein one section is a contacts section, including contact listings for different social themes.

10. The apparatus of claim 2, wherein one section is a subject matter section, including an area for course information and an area to record grades.

11. The apparatus of claim 2, wherein each storage unit carries a thematic message that is tied to particular indicia.

12. The apparatus of claim 2, wherein the storage unit is a folder.

13. The apparatus of claim 2, wherein the storage unit is a notebook.

14. The apparatus of claim 2, wherein the storage unit is a book cover.

15. An organizational apparatus, comprising:

an educational plan book having a plurality of sections including at least one section for recording daily assignments having a plurality of subsections, each subsection relating to a different academic subject and each subsection having different color, numerical and icon indicia providing the means for distinguishing a given subsection from other subsections; and at least one document storage unit separate and apart from the educational plan book corresponding to each of the subsections in the plan book and the storage units having the same identifying color, numerical and icon indicia as its corresponding plan book subsection.

* * * * *